US005676300A

United States Patent [19]

Nakazato et al.

[11] Patent Number: 5,676,300

[45] Date of Patent: Oct. 14, 1997

[54] SOUND REDUCTION APPARATUS FOR PNEUMATIC TYPE NAILING MACHINE

[75] Inventors: Takashi Nakazato; Masaru Sekita, both of Tokyo, Japan

[73] Assignee: Max Co., Ltd., Tokyo, Japan

[21] Appl. No.: 551,745

[22] Filed: Nov. 7, 1995

[30] Foreign Application Priority Data

Nov. 7, 1994 [JP] Japan ..... 6-297882

[51] Int. Cl.[6] ..... B25C 1/04

[52] U.S. Cl. ..... 227/130

[58] Field of Search ..... 227/9, 10, 130; 173/DIG. 2

[56] References Cited

U.S. PATENT DOCUMENTS

| | | | |
|---|---|---|---|
| 4,380,313 | 4/1983 | Klaus et al. | 227/130 |
| 4,407,390 | 10/1983 | Le Blanc, Jr. | 173/DIG. 2 |
| 4,609,135 | 9/1986 | Elliesen | 173/DIG. 2 |
| 4,773,581 | 9/1988 | Ohtsu et al. | 227/10 |
| 5,423,469 | 6/1995 | Armstrong | 227/9 |

FOREIGN PATENT DOCUMENTS

| | | |
|---|---|---|
| 0 006 246 | 1/1980 | European Pat. Off. . |
| 0 065 142 | 11/1982 | European Pat. Off. . |
| 1 448 384 | 9/1976 | United Kingdom . |

*Primary Examiner*—Scott A. Smith

*Attorney, Agent, or Firm*—Cushman Darby & Cushman IP Group of Pillsbury Madison & Sutro LLP

[57] ABSTRACT

A sound reduction apparatus for a pneumatic type nailing machine in which a driving piston is driven by compressed air to drive a nail and the compressed air is exhausted from an exhaust port after driving is provided. The sound reduction apparatus includes a sound reduction chamber configured for receiving the compressed air from the exhaust port and exhausting the air after driving. The sound reduction chamber includes a wall defining a plurality of exhaust slits extending circumferentially about the sound reduction chamber. The exhaust slits are constructed and arranged to exhaust the compressed air from the sound reduction chamber in a substantially laminar flow thereby reducing an intensity of exhaust sound.

5 Claims, 3 Drawing Sheets

SOUND REDUCTION APPARATUS FOR PNEUMATIC TYPE NAILING MACHINE

BACKGROUND OF THE INVENTION.

1. Field of the Invention

The present invention relates to a sound reduction apparatus for effectively reducing the exhaust sound emitted from a pneumatic type nailing machine.

2. Description of the Related Art

Recently, strict regulations against emitting noise are being required. Even when nails are driven, there is a strong demand for reducing the sound caused in the process of driving.

In this connection, in the operation of a pneumatic type nailing machine, the pressure of compressed air is adjusted to the most appropriate value in accordance with the type of material into which nails are driven. That is, when the material into which nails are driven is hard, the pressure of compressed air is set high. When the material into which nails are driven is soft, the pressure of compressed air is set low. This technique is disclosed, for example, in Japanese Examined Utility Model Publication No. 47-36931.

However, when the box nailing machine is equipped with a sound reduction apparatus, operation of the nailing machine is disturbed, and workability of the nailing machine is lowered. Therefore, it is actually difficult to provide a sufficiently large space for the reduction of exhaust air sound. In order to solve the above problems, it is possible to reduce the exhaust air sound by using a highly dense filter, the dimensions of which are small. In this case, the exhaust air resistance is increased, and the back pressure on an upper side of the driving piston is increased. As a result, the driving piston can not be returned quickly, and a period of time required for continuously driving the nails is elongated.

SUMMARY OF THE INVENTION

The present invention has been accomplished to solve the above problems. It is an object of the present invention to provide a sound reduction apparatus used for a pneumatic type nailing machine in which: an intensity of exhaust air sound is effectively reduced; and the dimensions of the sound reduction apparatus are decreased as small as possible without deteriorating the returning performance of the driving piston.

In order to accomplish the above object, the present invention is to provide a sound reduction apparatus for a pneumatic type nailing machine in which a driving piston is driven by compressed air to drive a nail and the compressed air is exhausted from an exhaust port after driving, said sound reduction apparatus including: a sound reduction chamber arranged outside the exhaust port; and a plurality of exhaust slits formed into a multi-layer, the circumferential walls of which are cut into round slices, for exhausting the exhaust air from the sound reduction chamber so that a laminar air flow can be formed by the exhaust air.

According to the present invention, the exhaust air is not directly discharged from an exhaust section of the box nailing machine, but the exhaust air is once diffused in a sound reduction chamber and then discharged from exhaust slits. That is, the pressure of air is reduced in the pressure reduction chamber so that an intensity of the exhaust air sound is primarily reduced, and further the exhaust air is discharged from the exhaust slits, wherein the exhaust air is formed into a laminar flow. When the exhaust air is discharged in a laminar flow, it is difficult to cause a turbulence in the exhaust air flow. Accordingly, the exhaust air sound is reduced. When the exhaust air is formed into a turbulent flow, a vortex is generated, so that the exhaust air sound is caused. However, when the exhaust air is formed into a laminar flow, the exhaust air sound is seldom caused. Further, one slit is continuously formed on the substantially entire circumference. Accordingly, the overall exhaust air is formed into a laminar flow, so that the occurrence of turbulence can be avoided. In this way, the sound reduction is effectively conducted, so that an intensity of the exhaust sound can be greatly reduced.

Since the sound reduction chamber is arranged outside the exhaust air port, it is possible to reduce the dimensions of the sound reduction chamber as small as possible, so that the overall device can be made compact. Accordingly, the operation property of the device is not deteriorated.

Since the air exhaust slits are formed into a multi-layer so that a large space can be formed for exhausting air, it is possible to reduce an intensity of the sound without deteriorating the returning performance of the driving piston.

DETAILED DESCRIPTION OF THE PREFERRED EMBODIMENTS

Figure 1:
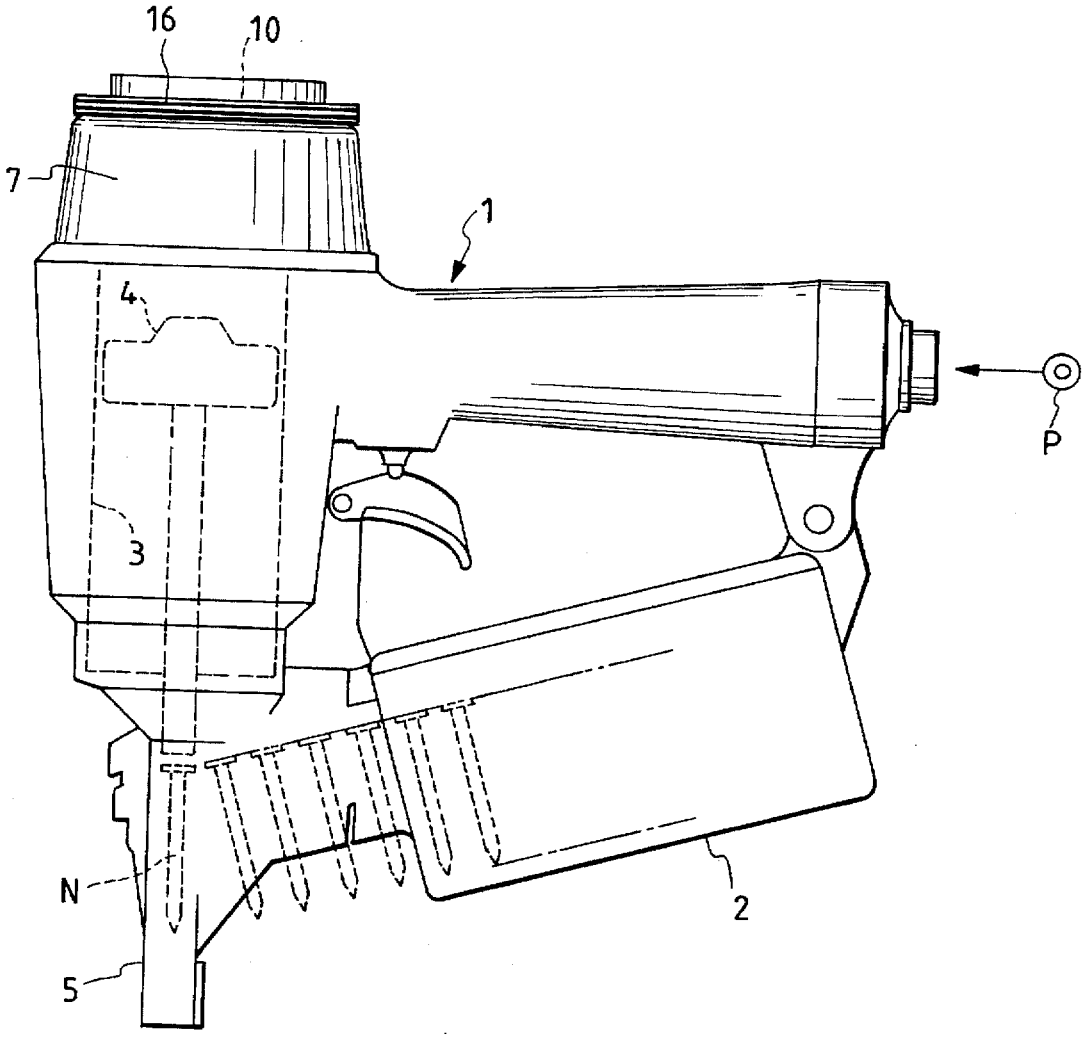
FIG. 1 is a schematic illustration for explaining an outline of the pneumatic type nailing machine according to the present invention.

FIG. 1 is an overall arrangement view of a pneumatic type nailing machine. This nailing machine is operated as follows. Compressed air is supplied to a nailing machine body 1 from a compressed air supply source P. A driving piston 4 in a driving cylinder 3 is moved by the action of compressed air sent from the compressed air supply source P. When the driving piston 4 is moved, a nail N supplied from a coil nail magazine 2 to a nose portion 5 is driven. After the nail N has been driven, the exhaust air is discharged from an exhaust port 6 (shown in FIG. 2).

Figure 2:
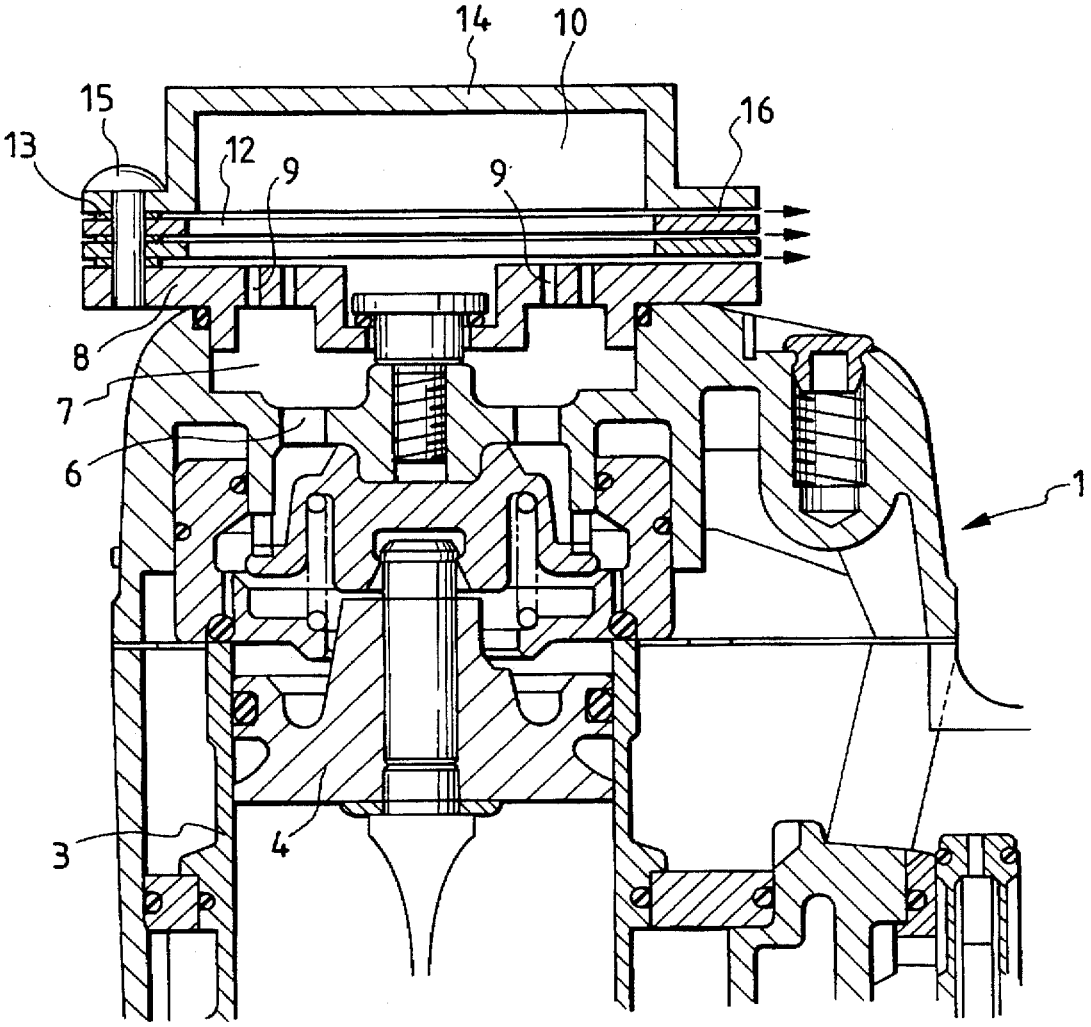
FIG. 2 is a cross-sectional view taken on line X—X in FIG. 1.
Figure 3:
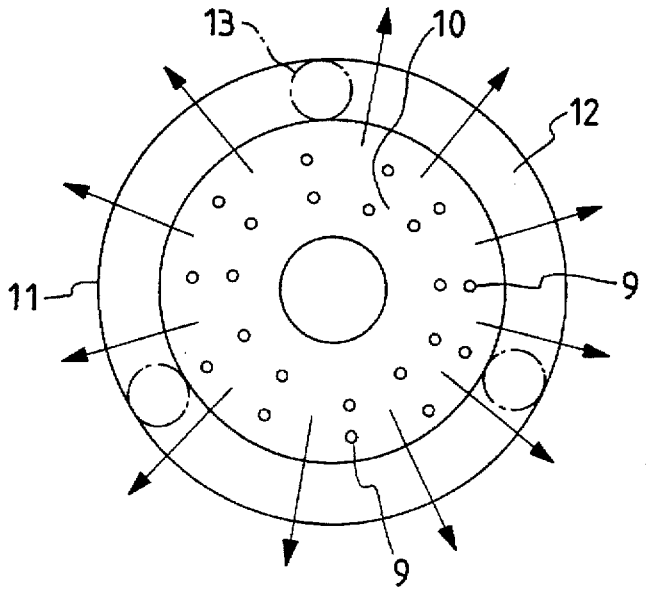
FIG. 3 is a plan view showing a state of a current of the exhaust air discharged from an exhaust air slit.

There is provided a first sound reduction chamber 7 on an upper side of the exhaust port 6. There is provided a base member 8 on the first sound reduction chamber 7. Exhaust air paths 9 are formed around a center of the base member 8. Downstream the exhaust air paths 9, there is provided a second sound reduction chamber 10. As illustrated in FIGS. 2 and 3, the second sound reduction chamber 10 is formed into a circular box-shape when the view is taken in the vertical direction. In this case, the second sound reduction chamber 10 may be formed into a square or elliptical box-shape. On the circumferential wall 11 of the second sound reduction chamber 10, doughnut-shaped disks 12 are stacked via the spacers 13 so that a multi-layer of the doughnut-shaped disks 12 can be formed. The thus stacked doughnut-shaped disks 12 are fixed by the screws 15 together with a cap 14. Due to the foregoing structure, exhaust air slits 16, which are substantially open in all directions, can be formed between the upper and the lower disks 12.

Figure 4:
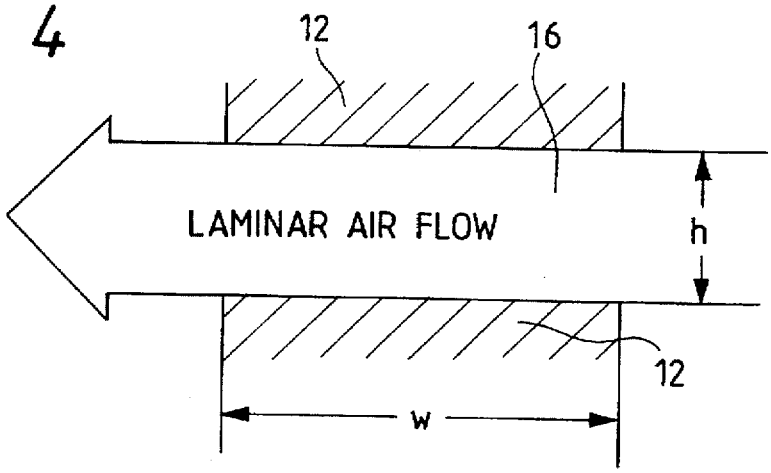
FIG. 4 is a cross-sectional view of a primary portion of the exhaust air slit.

In this connection, it is preferable that a ratio of the height "h" to the width "w" of the exhaust air slit 16 (shown in FIG. 4) satisfies the following inequality.

$$w \geqq 3h$$

When the dimensions of the exhaust air slit 16 satisfy the above condition, exhaust air passing through the exhaust air slits 16 is formed into a laminar flow, that is, a flow is formed in which no turbulence is caused. It can be said from the above condition that the smaller the height "h" of the exhaust air slit 16 is, the better the condition of the laminar flow is improved.

Figure 5:
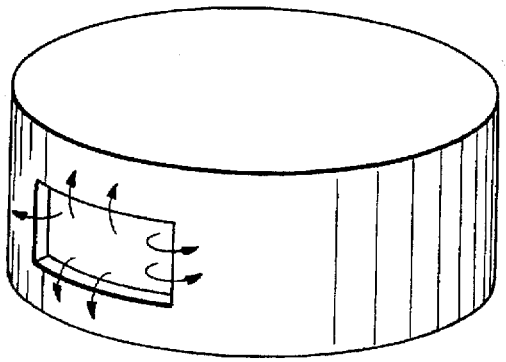
FIG. 5 is a schematic illustration for explaining a state in which the exhaust air is formed into in a turbulent flow.

According to the above structure, the exhaust air is not directly discharged from the exhaust port 6 of the box nailing machine into the atmosphere, but the exhaust air is once diffused in the first and the second sound reduction chamber 7, 10, and then discharged outside from the exhaust air slits 16. Pressure of the exhaust air is reduced in the first and the second pressure reduction chamber 7, 10, so that the exhaust air can be diffused in both chambers. Accordingly, the flow speed of exhaust air is suppressed, so that an intensity of the exhaust air sound can be decreased. Further, when the exhaust air is discharged from the exhaust air slits 16, it is formed into a laminar flow. When the exhaust air is formed into a laminar flow, a turbulence is seldom caused in the exhaust air. Therefore, an intensity of the exhaust air sound can be reduced. When the exhaust air is discharged from the exhaust air port in a turbulent flow as illustrated in FIG. 5, a vortex is generated. At this time, exhaust sound is caused. However, when the exhaust air is formed into a laminar flow, no vortex is generated, and the exhaust air sound is seldom caused. Further, one exhaust air slit 16 is continuously formed on substantially all the circumference. Accordingly, the overall exhaust air is formed into a laminar flow, and no turbulent flow is caused. As a result, it is possible to effectively reduce the exhaust air sound. Therefore, an intensity of the exhaust air sound can be greatly reduced by 10 to 12 dB as compared with an intensity of the exhaust air sound of the conventional nailing machine.

When resistance against the exhaust air is increased, back pressure on the upper side of the driving piston 4 is increased, and the returning performance of the driving piston 4 is deteriorated. Due to the defective returning motion of the driving piston 4, the driving force is lowered. However, according to the present invention, the exhaust air slits 16 are arranged into a multi-layer, so that a large exhaust air space is formed as a whole. Accordingly, it is possible to reduce an intensity of the exhaust air sound without deteriorating the returning performance of the driving piston 4.

What is claimed is:

1. A sound reduction apparatus for a pneumatic type nailing machine in which a driving piston is driven by compressed air to drive a nail and the compressed air is exhausted from an exhaust port after driving, said sound reduction apparatus comprising:

a sound reduction chamber configured for receiving the compressed air from the exhaust port and exhausting the air after driving, wherein a wall of the sound reduction chamber defines a plurality of exhaust slits extending circumferentially about the sound reduction chamber, said exhaust slits being constructed and arranged to exhaust the compressed air from the sound reduction chamber in a substantially laminar flow thereby reducing an intensity of exhaust sound.

2. A sound reduction apparatus according to claim 1, wherein a width and a height of each of said exhaust slits are satisfied by:

$$w \geqq 3h,$$

where w is the width of each exhaust slit in an air flow direction, and h is the height of each exhaust slit perpendicular to the air flow direction.

3. A sound reduction apparatus according to claim 1, wherein said sound reduction chamber comprises:

a base member having exhaust air paths;

a first sound reduction chamber disposed on one side of the base member; and a second sound reduction chamber disposed on the other side of the base member, wherein the compressed air passes from the first sound reduction chamber through the exhaust air paths of the base member to the second sound reduction chamber.

4. A sound reduction apparatus according to claim 3, wherein said second sound reduction chamber comprises a plurality of spaced-apart annular members, wherein spaces between said annular members provide said plurality of exhaust slits.

5. A sound reduction apparatus according to claim 1, wherein said sound reduction chamber comprises a plurality of spaced-apart annular members, wherein spaces between said annular members provide said plurality of exhaust slits.

* * * * *